United States Patent [19]

Aya et al.

[11] 4,114,124

[45] Sep. 12, 1978

[54] CONVERGENCE APPARATUS WITH VARIABLY MAGNETIZED MAGNETS

[75] Inventors: Masayoshi Aya, Ibaraki; Kohji Hiya, Hirakata, both of Japan

[73] Assignee: Matsushita Electric Industrial Co., Ltd., Kadoma, Japan

[21] Appl. No.: 808,567

[22] Filed: Jun. 21, 1977

[30] Foreign Application Priority Data

Jun. 25, 1976 [JP] Japan ..... 51-75690

[51] Int. Cl.[2] ..... H01F 7/00

[52] U.S. Cl. ..... 335/212; 335/210

[58] Field of Search ..... 335/210, 212, 284

[56] References Cited

U.S. PATENT DOCUMENTS

| | | | |
|---|---|---|---|
| 3,290,534 | 12/1966 | Kratz | 335/212 X |
| 3,725,831 | 4/1973 | Barbin | 335/210 X |
| 3,808,570 | 4/1974 | Thompson et al. | 335/212 |

*Primary Examiner*—George Harris

*Attorney, Agent, or Firm*—Stevens, Davis, Miller & Mosher

[57] ABSTRACT

A convergence apparatus having a pair of four-pole static magnets and a pair of six-pole static magnets mounted rotatably at the neck portion of an in-line color CRT having three electron guns arranged laterally in a single file such that the pair of four-pole static magnets and a pair of six-pole static magnets are arranged in the axial direction of the neck portion. The magnetization density of the N poles and that of the S poles of at least one of the pairs of four-pole magnets and six-pole magnets are made to be different, and further the magnetization density of the two sheets of the static convergence magnets of which the magnetization density of the N poles and that of the S poles are different are made to be different, and thereby more certain and complete correction can be attained.

1 Claim, 14 Drawing Figures

CONVERGENCE APPARATUS WITH VARIABLY MAGNETIZED MAGNETS

FIELD OF THE INVENTION

The present invention relates to a convergence apparatus for an in-line color CRT having three electron guns arranged laterally in a single file.

DETAILED DESCRIPTION

Figure 1A:
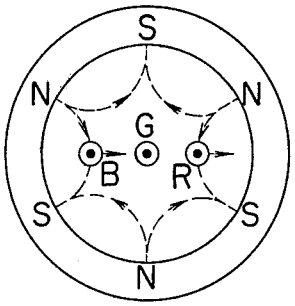
FIG. 1a PRIOR ART
FIGS. 1*a* and 1*b* show plan views of magnets of a prior art convergence apparatus.
Figure 1B:
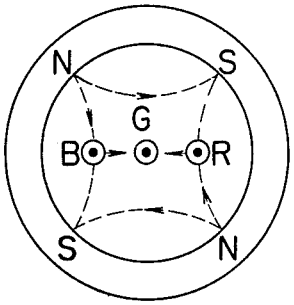
FIG. 1b PRIOR ART
Figure 2:
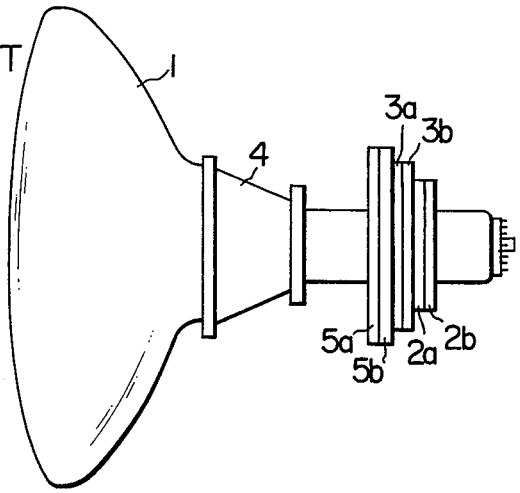
FIG. 2 PRIOR ART
FIG. 2 shows a side elevational view of the prior art apparatus.
Figure 3:
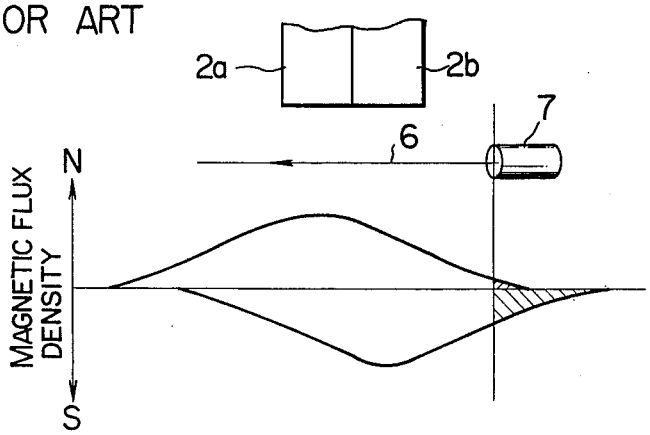
FIG. 3 PRIOR ART
FIG. 3 illustrates a principle of the prior art apparatus.

It has been known to arrange at the neck of an in-line color CRT having three electron guns arranged laterally in a single file a pair of six-pole magnets and a pair of four-pole magnets for adjusting static convergence. Such an apparatus operates well when a large amount of adjustment by the magnets is required, however, the presence of the correction magnets becomes a defect for the CRT which requires little correction. More particularly, when no correction is required, a pair of six-pole magnets shown in FIG. 1*a* and a pair of four-pole magnets shown in FIG. 1*b* are stacked in pairs such that N poles and S poles of the pair of six-pole magnets are made to coincide to cancel each other while N poles and S poles of the pair of four-pole magnets are made to coincide to cancel each other. However, as shown in FIG. 2, since the six-pole magnets 2*a* and 2*b* and the four-pole magnets 3*a* and 3*b* mounted at the neck of the CRT 1 are arranged in the proceeding direction of beam, the distributions of the magnetic flux becomes ones which are shifted in the proceeding direction of beam as shown in FIG. 3 even if the N poles and the S poles are coincided and therefore the both distributions are not completely cancelled. That is, those magnetic fluxes which lie in an area where no beam exists (hatched areas in FIG. 3) become meaningless for the correction. Thus, the magnetic fluxes which are effective for the correction are reduced, and an unbalance occurs in the amount of effective magnetic fluxes of the two sheets of magnets. As a result, both magnetic fluxes do not completely cancel each other.

In order to solve the above problems, it has been considered to provide a difference between the amount of magnetic fluxes of the pair of magnets in order to make the amount of effective magnetic fluxes of the pair of magnets equal. Even with this approach, however, the effective magnetic fluxes are not completely cancelled because of variations in the material of the magnets and the magnetization thereof. In FIG. 2, numeral 4 denotes a deflection yoke, 5*a* and 5*b* denote purity magnets, and in FIG. 3, numeral 6 denotes a beam and 7 denotes an electron gun.

It is an object of the present invention to provide a convergence apparatus which enables more complete correction.

A preferred embodiment of the present invention will now be explained with reference to the accompanying drawings.

Figure 4A:
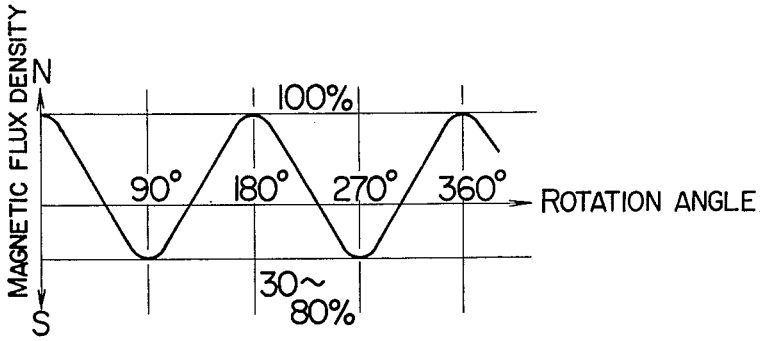
FIGS. 4*a* and 4*b* show a chart illustrating magnetic flux density for explaining a convergence apparatus of the present invention.
Figure 4B:
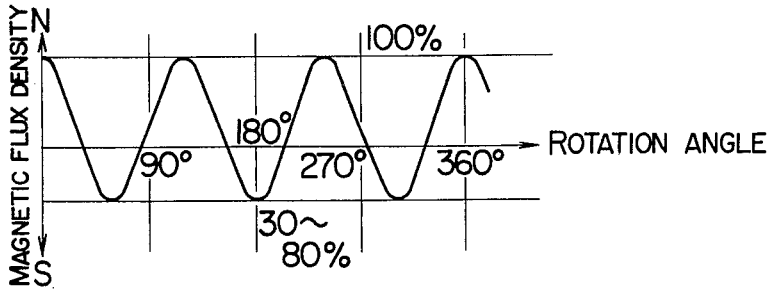

A construction of the apparatus of this invention is similar to that of the apparatus shown in FIGS. 1 and 2, and a pair of six-pole magnets and a pair of four-pole magnets for generating a six-pole magnetic field and a four-pole magnetic field, respectively, are magnetized such that magnetization densities of the N poles and the S poles of at least one of the pairs are made to be different. For example, when the magnetization is such that the magnetization density of the N pole is larger than that of the S pole, the magnetic flux distribution becomes one as shown in FIGS. 4*a* and 4*b*, in which FIG. 4*a* shows the distribution for the four-pole magnet and FIG. 4*b* shows the distribution for the six-pole magnet. Since the six-pole magnet and the four-pole magnet. operate in the same principle, it will be described below only with respect to the four-pole magnet. The characteristic shown in FIG. 4*a* can be obtained by using the magnets 5*a*, 5*b*, 3*a*, 2*a* and 2*b* shown in FIG. 2 in which the magnets 5*a*, 5*b*, 3*b*, 2*a* and 2*b* are not magnetized and only the magnet 3*a* is four-pole magnetized as shown in FIG. 1*b* (with the magnetization of the N pole being larger than that of the S pole), and by inserting a probe of measurement in the neck portion of the CRT tube while rotating the magnet 3*a*. In FIG. 4, the ordinate represents the magnetic flux density and the abscissa represents a rotation angle of the magnet 3*a*

Figure 5:
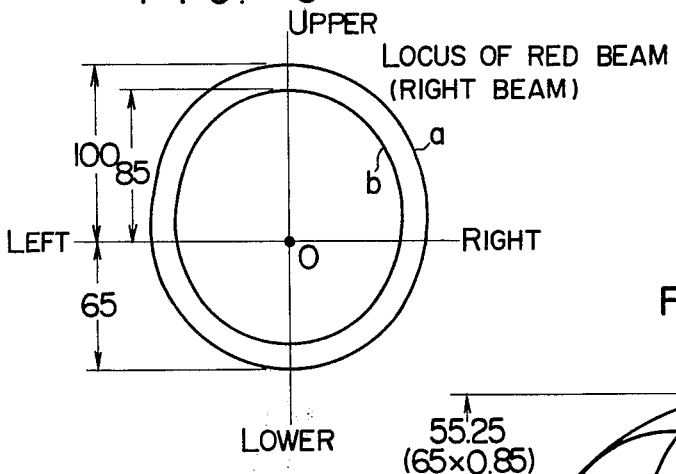
FIGS. 5, 6 and 7 show beam loci of the present apparatus.

The movement of the beam when a single sheet of magnet, i.e., the magnet 3*a* is made to act becomes as shown by a in FIG. 5, because there is difference between the magnetic flux amount of N pole and that of S pole and different amounts of force are applied upwards and downwards to the non-corrected beam position. FIG. 5 shows a locus of a right beam, that is, red beam on a CRT screen, and O in FIG. 5 shows a beam position when the magnet 3*a* is not used and no correction is made. If the magnet 3*a* is not magnetized and the magnet 3*b*, i.e., the single sheet of magnet mounted at the exit of the beam is magnetized, the amount of correction decreases as shown by *b* in FIG. 5 because the amount of effective magnetic flux decreases. A rate of decrease changes depending on the mounting position on the CRT and varies between 60% and 95% within a range of a possible mounting position of a convergence yoke. The rate becomes constant when the mounting position is determined. When such a pair of magnets are combined, the trace of the beam becomes one as shown in FIG. 6, and a correction area within outermost peripheries except a center area 8 can be obtained.

Figure 6:
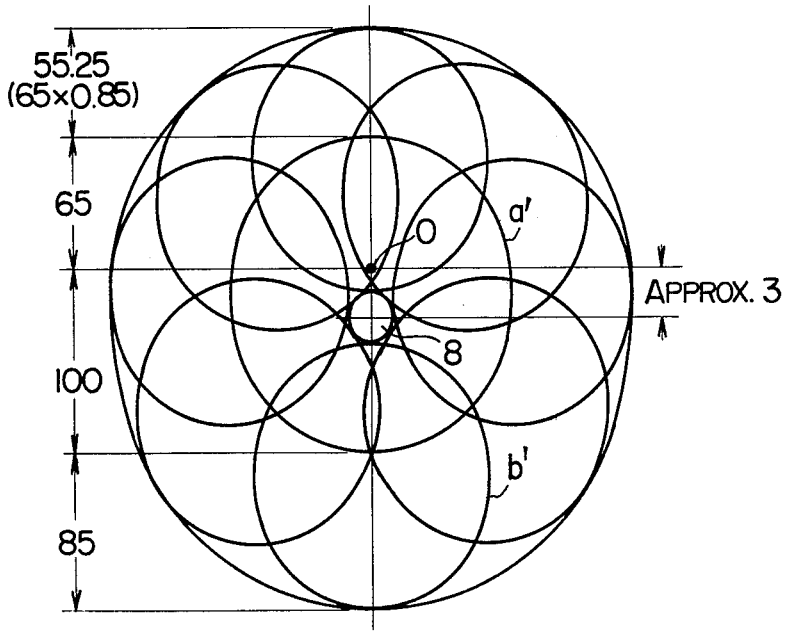

FIG. 6 shows the beam locus for a left beam, that is, blue beam. The difference between the correction amount in upwards and that in downwards for the red beam becomes opposite to that for the blue beam. Since the beam position when no correction is made is point O in FIG. 6, the combination of the pair of magnets can be adjusted in a wide range it is possible to carry out correction easily and completely. In FIG. 6, *a'* shows a locus for the red beam which corresponds to *a* in FIG. 5, and *b'* shows a locus for the blue beam which corresponds to *b* in FIG. 5. The centers of the loci *b'* lie on the locus *a'*.

Figure 7:
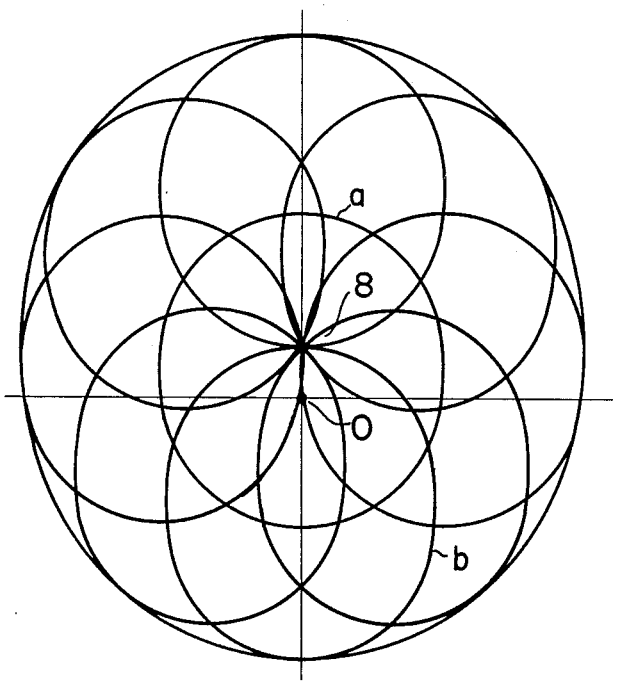

As shown by a line 8 in FIG. 6, in a certain area which lies below non-correction position for the blue beam and in a certain area which lies above non-correction position for the red beam, it is not possible to make correction by any combination. This area is determined by the ratio of magnetization of the N pole and that of the S pole, and this area becomes more distant from the non-correction position as the magnetization ratio increases and the area becomes wider as the difference of the amounts of correction by the two sheets of magnets increases. For example, when the ratio of the amounts of movement due to the difference between the N pole and the S pole is 100 to 65 and the ratio of the amounts of correction by the two sheets of magnets due to the difference of the mounting position is 100 to 85, the non-correctable area is approximately 32% of the maximum correction amount, and the area in which it is impossible to make correction becomes one within a circle having a diameter which is equal to approximately 25% of the maximum correction amount. By designing the apparatus such that the non-correctable area may be apart from the center as far as possible, it becomes very rare that the operating range falls within the non-correctable area even taking into consideration the variations in the manufacture of the CRT. However, in actual design, it is difficilt to design in this way, therefore, it is necessary to reduce the non-correctable area as much as possible. Accordingly, in the present invention, the magnetization density of the magnets at the exit of the beam where the amount of effective magnetic flux becomes small, that is, the magnets 3*b* and 2*b* in FIG. 2, is increased so that the correction amounts of the two sheets of magnets may become equal. As a result, a pattern shown in FIG. 7 is obtained, in which the non-correctable area 8 is minimized (principally zero) and substantially complete correction can be attained.

Figure 8:
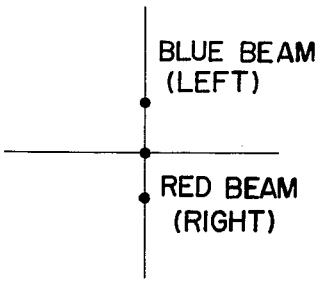
FIG. 8 illustrates a principle for explaining the present apparatus.

Although the means to make it possible to carry out a complete correction by providing a difference between the magnetic flux densities of the pair of magnets is similar to those in the pair art, in the case of the in-line CRT it is very rare that the gun convergence as shown in FIG. 8 occurs because the apparatus is designed such that the position of the beam may vary in an area where no correction is required or may very in the lateral direction. Accordingly, it is confirmed that the probability is less than 10% in comparison with the case where the correction is not required.

When the apparatus is designed such that the magnetization of the N pole is smaller than the magnetization of the S pole, difference of the movement in upward and downward directions of the beam position in the beam correction area becomes the reverse of that in the previous case and the area in which correction is difficult (gun convergence) comes to lie above the non-corrected position for the blue beam and below the non-corrected position for the red beam, and this is entirely the reverse of that in the previous case. However, the same effect can be attained.

In the above, description has been made with respect to the four-pole static magnets, but the convergence apparatus may be constructed in the same way by using the six-pole static magnets. Although the advantage of the present invention can be attained by any one of a pair of four-pole static magnets or pair of six-pole static magnets, more complete convergence apparatus can be obtained when the both pairs are used to construct the convergence apparatus of this invention.

Figure 9A:
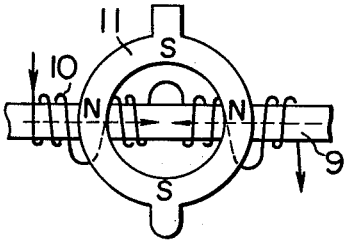
FIGS. 9*a*, 9*b*, 9*c* and 9*d* show magnetizing patterns.
Figure 9B:
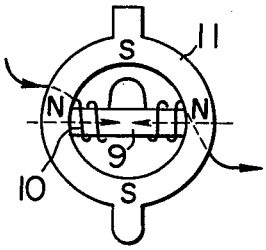
Figure 9C:
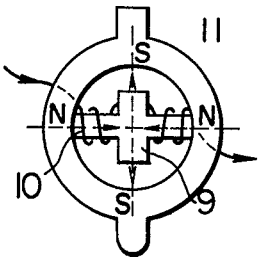
Figure 9D:
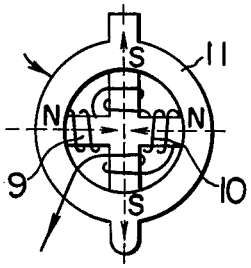

A method for making the magnetic flux density of the N pole and that of the S pole to be different will be explained below. As shown in FIG. 9*a*, in winding a coil 10 on a magnetizing head 9 and supplying a current therethrough N pole and S pole are produced in a magnet member 11 as shown in the figure, and a ratio of the magnetic fluxes becomes 0.2 to 0.4. In the case of FIG. 9*b*, the ratio of the magnetic fluxes becomes 0.4 to 0.6, in the case of FIG. 9*c*, 0.6 to 0.9, and in the case of FIG. 9*d*, 0.9 to 1.0. In this way, any desired magnetization can be obtained as occasion demands.

As described above, according to this invention more complete static convergence correction can be carried out.

What is claimed is:

1. A convergence apparatus comprising a pair of four-pole static magnets and a pair of six-pole static magnets mounted rotatably at a neck portion of an in-line color CRT having three electron guns arranged in horizontal line laterally in a single line, said pairs of static magnets being arranged in the axial direction of the neck portion, wherein a magnetization density of N poles and that of S poles of at least one of said pair of four-pole static magnets and said pair of six-pole static magnets are made to be different from each other, and in the pair of static magnets of which the magnetization density of N poles and that of S poles are made to be different from each other the magnetization density of a static magnet which lies closer to an electron beam exit of said CRT is made to be larger than the magnetization density of the other static magnet.

* * * * *